US006534919B1

(12) United States Patent
Bachmann et al.

(10) Patent No.: US 6,534,919 B1
(45) Date of Patent: Mar. 18, 2003

(54) DISCHARGE LAMP HAVING ELECTRODE PART WITH NEGATIVE ELECTRON AFFINITY

(75) Inventors: Peter K. Bachmann, Würselen (DE); Bernd Rausenberger, Aachen (DE); Howard Wilson, Aachen (DE); Albrecht Kraus, Kerkrade (NL); Norbert Braun, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/451,273

(22) Filed: Nov. 30, 1999

(30) Foreign Application Priority Data

Nov. 30, 1998 (EP) ..... 98204044

(51) Int. Cl.[7] ..... H01J 17/04; H01J 61/04

(52) U.S. Cl. ..... 313/631; 313/632; 313/633; 313/491

(58) Field of Search ..... 313/491, 631, 313/632, 633

(56) References Cited

U.S. PATENT DOCUMENTS 2,624,858 A 1/1953 Greenlee ..... 313/201
4,092,560 A * 5/1978 Puskas ..... 313/244
5,663,611 A * 9/1997 Seats et al. ..... 313/491
5,880,559 A * 3/1999 Fox et al. ..... 313/633
6,194,833 B1 * 2/2001 DeTemple et al. ..... 313/631

FOREIGN PATENT DOCUMENTS

GB 2297862 8/1996 ..... H01J/17/49

OTHER PUBLICATIONS

Kraus et al., Low–Pressure Gas Discharge Lamp, 09–2001, USPTO.*

* cited by examiner

*Primary Examiner*—Ashok Patel
*Assistant Examiner*—Glenn Zimmerman
(74) *Attorney, Agent, or Firm*—Frank J. Keegan; Dicran Halajian

(57) ABSTRACT

In a capacitively coupled discharge lamp the electrode comprises a dielectric material that during operation is in contact with the discharge. The impedance of the dielectric material is small and its electron affinity is negative. In this way it is realized that the discharge lamp can be operated efficiently at low frequencies (less than 500 KHz).

8 Claims, 1 Drawing Sheet

DISCHARGE LAMP HAVING ELECTRODE PART WITH NEGATIVE ELECTRON AFFINITY

BACKGROUND OF THE INVENTION

The invention relates to a discharge lamp equipped with a gastight discharge vessel containing a gas and equipped with electrodes, at least one of the electrodes comprising

- a first part that is suitable for connection to a pole of a supply voltage source and that during operation is capacitively coupled to the discharge in the discharge lamp,
- a second part formed out of a first dielectric material, said second part being connected to the first part and during operation of the discharge lamp being in contact with the discharge.

Such a discharge lamp is known from U.S. Pat. No. 2,624,858. In the known discharge lamp the first part of both electrodes is formed out of metal or deposited graphite. The second part of the electrodes is relatively thick and the dielectric constant $\in$ of first dielectric material is higher than 100. During operation of the lamp the operating voltage that is applied to the first part of the first electrode and the first part of a second electrode is coupled capacitively to the discharge by means of the second part of the first electrode and the second part of the second electrode. Both electrodes form capacitive impedances during the operation of the lamp. These capacitive impedances render the current/voltage characteristic of the discharge lamp positive so a separate external ballast element can be dispensed with. Since the dielectric constant $\in$ of first dielectric material is higher than 100, the capacitive impedances of both electrodes are relatively low, so that the lamp can be operated at relatively low frequencies (e.g. less than 500 KHz). An important disadvantage of the known discharge lamp, however, is that virtually each material that has a high dielectric constant also has a relatively high electron affinity. Because of this high electron affinity electrons adhere relatively strongly to the surface of the second parts of the electrodes. This results in a relatively high lamp voltage, a corresponding low efficiency of the lamp and also to blackening of the wall of the discharge vessel in the vicinity of the electrodes.

The invention aims to provide a discharge lamp that during operation is capacitively coupled to a supply voltage source and can be operated by means of a low frequency (less than 500 KHz) supply voltage, with a relatively high efficiency and a relatively low amount of blackening of the discharge vessel.

SUMMARY OF THE INVENTION

In accordance with the invention the electron affinity $\chi$ of the first dielectric material is negative.

It has been found that the negative electron affinity of the first dielectric material causes the efficiency of a discharge lamp to be relatively high. In practice the dielectric constant of the first dielectric material is very often relatively low, e.g. lower than 10. In order to keep the capacitive impedances of the electrodes acceptably low, it is often necessary to choose the thickness of the dielectric material in the direction of the lamp current relatively small, i.e. smaller than 100 $\mu$m, whereas the best results have been obtained thicknesses smaller than 1 $\mu$m.

Very good results have been obtained for discharge lamps in which the first dielectric material is chosen from the group formed by diamond, AlN, AlGaN and BN.

Since in practice the second part of the electrode is relatively thin it is often desirable to realize electrical insulation of the first electrode part from the discharge making use of a third part consisting of a second dielectric material having a dielectric constant $\in$ higher than 100 and preferably higher than 1000, the third part of the electrode being situated between and in contact with both the first part and the second part of the electrode.

Preferably the first part of an electrode in a discharge lamp according to the invention has flat metallic layer while the second part comprises a sheet of the first dielectric material parallel to the flat metallic layer. In case the electrode comprises a third part, this third part can conveniently be realized in case it comprises a sheet of the second dielectric material parallel to the first and the second part of the electrode.

It has been found in practice that it is desirable for the electrode to comprise a carrier for rendering mechanical strength to the electrode construction, the carrier being in parallel with the second electrode part. The carrier can be a separate part of the electrode but it is also possible that the carrier is formed by the first electrode part.

In case the electrode comprises a third part, the carrier can also be formed by this third part.

DETAILED DESCRIPTION OF THE PREFERRED EMBODIMENTS

Figure 1:
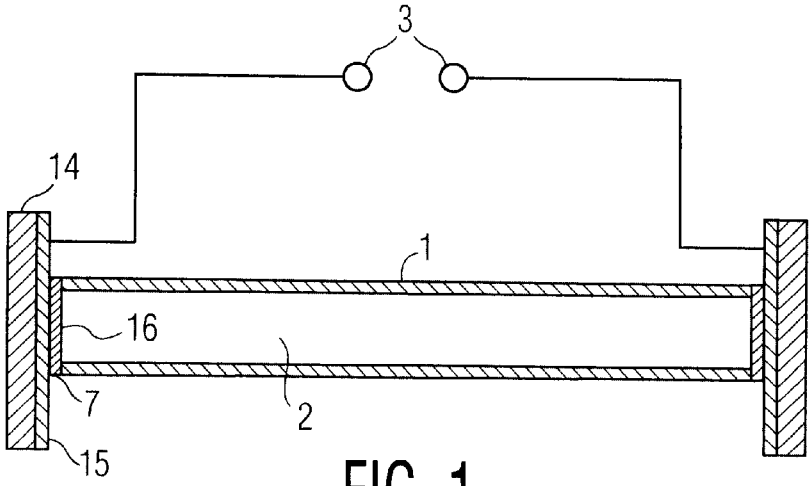
FIG. 1 shows a schematic representation of a discharge lamp according to the invention.

In FIG. 1, each electrode is formed by a first part 15 and a second part 16 on a glass carrier 14. Contacts 3 are provided for connection to the poles of a supply voltage source, and are connected to the first parts 15 of respective electrodes. A space 2 is enclosed by the electrodes and the discharge vessel 1, where the discharge is present during operation of the discharge lamp. A gastight seal 7 is present between the electrodes and the discharge tube. In this embodiment the electrodes, the discharge tube 1 and the seals 7 between discharge tube and electrodes together form a gastight discharge vessel.

The electrodes were manufactured as follows. A sheet of glass (Corning 7059) was covered with a layer of titanium with a thickness of approximately 100 nm by means of evaporation. The glass sheet including the titanium layer was treated at a temperature of 600 C. in a reducing atmosphere during 30 minutes. During this treatment diffusion of titanium into the glass takes place resulting in an electrically conductive and mechanically stable titanium layer. Next the titanium layer was ground with diamond powder to implant diamond particles in the surface of the titanium layer. The sheet was then covered with a diamond layer by means of a microwave CVD process carried out at a temperature of 650 C. and a pressure of 15 torr. The power of the microwaves was 800 Watt and a gas mixture containing carbon, hydrogen and oxygen was used. The thickness of the diamond sheet was approximately 300 nm and it was H-terminated, meaning that its surface was covered with hydrogen. By making use of a mask it was realized that the diameter of the diamond layer was slightly bigger than the inner diameter of the discharge tube. The titanium layer and the diamond layer were connected to the discharge tube 1 in gastight way making use of a glass containing lead at a temperature of approximately 650 C. The lamp vessel was evacuated and filled with 5 mg mercury and 3 mBar argon. In the electrodes used in this discharge lamp the titanium layer forms a first part 15, the diamond layer forms a second part 16 and the glass forms a carrier 14 of the electrode. By means of UV photo electron spectroscopy an electron affinity $\chi$ of approximately −1 eV was found for the hydrogen covered diamond layer.

Figure 2A:
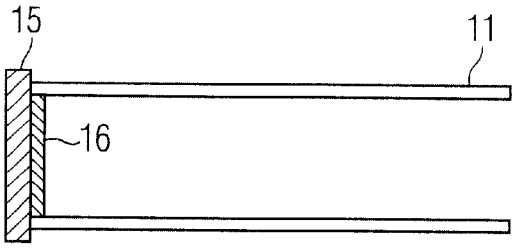
FIGS. 2A–2C show three alternative electrode configurations that can be used in discharge lamp according to the invention.
Figure 2B:
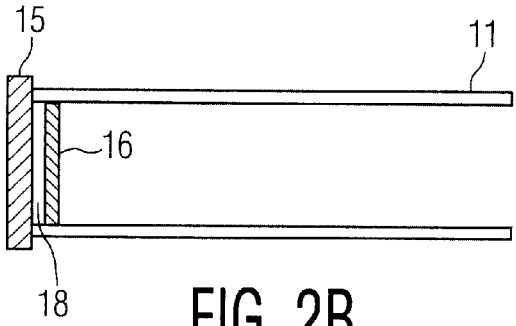
Figure 2C:
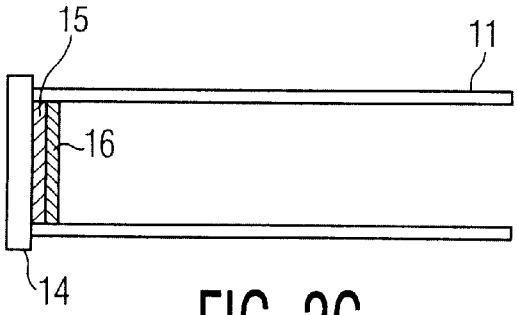

In all three electrode configurations of FIGS. 2A–2C, a first electrode part 15 is a layer of an electrically conductive material such as a metal and a second part 16 of the electrode is formed out of a first dielectric material. The second part 16 is connected to the first part 15 and is in contact with the discharge enclosed by wall 11 during operation of the lamp. In the embodiments of FIGS. 2A and 2C, the second electrode part 16 is directly connected to the first electrode part 15. In the embodiment of FIG. 2B a third electrode part 18 is formed out of a second dielectric material having a dielectric constant $\in$ higher than 100 and preferably higher than 1000, the third part of the electrode and is situated between and in contact with both the first part 15 and the second part 16 of the electrode. In embodiment of FIG. 2C, a carrier 14 is formed out of a dielectric material that is in contact with the the first part 15 of the electrode; the electrode construction is very similar to that shown in FIG. 1. During lamp operation the poles of a supply voltage source are electrically connected to the first part 15 of the electrode.

What is claimed is:

1. Discharge lamp equipped with a gastight discharge vessel containing a gas and equipped with electrodes, at least one of said electrodes comprising:

a first part that is suitable for connection to a pole of a supply voltage source and that during operation is capacitively coupled to the discharge in the discharge lamp, a second part formed out of a first dielectric material, said second part being connected to the first part and during operation of the discharge lamp being in contact with the discharge, the electron affinity of the first dielectric material being negative, said electrodes and said supply voltage source sustaining the discharge in the discharge lamp, wherein, the electrode comprises a third part consisting of a second dielectric material having a dielectric constant higher than 100, the third part of the electrode being situated in between and in contact with both the first part and the second part of the electrode.

2. Discharge lamp according to claim 1, wherein the third part comprises a sheet of the second dielectric material parallel to the first part and the second part of the electrode.

3. Discharge lamp according to claim 1, wherein the second dielectric material has a dielectric constant higher than 1000.

4. Discharge lamp equipped with a gastight discharge vessel containing a gas and equipped with electrodes, at least one of said electrodes comprising:

a first part that is suitable for connection to a pole of a supply voltage source and that during operation is capacitively coupled to the discharge in the discharge lamp;

a second part formed out of a first dielectric material, said second part being connected to the first part and during operation of the discharge lamp being in contact with the discharge, the electron affinity of the first dielectric material being negative;

said electrodes and said supply voltage source sustaining the discharge in the discharge lamp; and the said at least one of the electrodes further comprising a carrier for rendering mechanical strength to the electrode construction, said carrier being parallel to the second electrode part, the carrier forming a third electrode part consisting of a second dielectric material having a dielectric constant higher than 100, the third part of the electrode being situated in between and in contact with both the first part and the second part of the electrode.

5. Discharge lamp according to claim 4, wherein the second dielectric material has a dielectric constant higher than 1000.

6. Discharge lamp equipped with a gastight discharge vessel containing a gas and equipped with electrodes, said electrodes being arranged in the discharge space opposite each other and each with a flat surface substantially parallel to the flat surface of the other, at least one of said electrodes comprising:

a first part connected to a contact, the contact being connected during operation of the lamp to a pole of a supply voltage source, the first part, during operation, being capacitively coupled to the discharge in the discharge lamp;

a second part formed out of a first dielectric material, said second part being connected to the first part and during operation of the discharge lamp being in contact with the discharge;

the electron affinity of the first dielectric material being negative;

a third part consisting of a second dielectric material having a dielectric constant higher than 100, the third part of the electrode being situated in between and in contact with both the first part and the second part of the electrode.

7. Discharge lamp according to claim 6, wherein the third part comprises a sheet of the second dielectric material parallel to the first part and the second part of the electrode.

8. Discharge lamp equipped with a gastight discharge vessel containing a gas and equipped with electrodes, said electrodes being arranged in the discharge space opposite each other, each with a flat surface substantially parallel to the flat surface of the other, at least one of said electrodes comprising:

a first part that is connected to a contact, the contact being connected during operation of the lamp to a pole of a supply voltage source, and that during operation is capacitively coupled to the discharge in the discharge lamp;

a second part formed out of a first dielectric material, said second part being connected to the first part and during operation of the discharge lamp being in contact with the discharge;

the electron affinity of the first dielectric material being negative;

the electrode comprising a carrier for rendering mechanical strength to the electrode construction, said carrier being parallel to the second electrode part; and the carrier forming a third electrode part consisting of a second dielectric material having a dielectric constant higher than 100, the third part of the electrode being situated in between and in contact with both the first part and the second part of the electrode.

* * * * *